US011642602B2

(12) United States Patent
Goff

(10) Patent No.: US 11,642,602 B2
(45) Date of Patent: May 9, 2023

(54) RETROFITTABLE POSABLE TOY HAND ASSEMBLY AND METHOD

(71) Applicant: Christene E. Goff, Kranzburg, SD (US)

(72) Inventor: Christene E. Goff, Kranzburg, SD (US)

( * ) Notice: Subject to any disclaimer, the term of this patent is extended or adjusted under 35 U.S.C. 154(b) by 52 days.

(21) Appl. No.: 17/233,641

(22) Filed: Apr. 19, 2021

(65) Prior Publication Data

US 2022/0331705 A1 Oct. 20, 2022

(51) Int. Cl.
*A63H 3/04* (2006.01)
*A63H 3/52* (2022.01)

(52) U.S. Cl.
CPC ..... *A63H 3/04* (2013.01); *A63H 3/52* (2013.01)

(58) Field of Classification Search
CPC ..... A63H 3/04; A63H 3/46; A63H 3/52
USPC ..... 446/382, 370, 373, 374, 376
See application file for complete search history.

(56) References Cited

U.S. PATENT DOCUMENTS 534,933 A 2/1895 Weaver
620,598 A * 3/1899 Lyons ..... A63H 3/04 446/373
1,304,201 A * 5/1919 Ralston et al. ..... A63H 3/04 446/374
1,428,677 A * 9/1922 Barry ..... A63H 3/02 446/394
1,621,434 A * 3/1927 Rommer ..... A63H 9/00 446/390
2,109,422 A * 2/1938 Haughton ..... G03B 15/08 446/374
2,134,974 A * 11/1938 Hurwitz ..... A63H 3/04 223/78
2,202,805 A * 5/1940 Wood ..... A63H 9/00 446/374
3,055,119 A * 9/1962 Mcewen ..... E04C 5/00 434/82
3,070,922 A * 1/1963 Weih ..... A63H 3/46 446/381
3,624,691 A * 11/1971 Robson ..... A63H 3/04 446/374
4,030,240 A * 6/1977 Port ..... A63H 3/12 446/390
5,432,991 A * 7/1995 Godleski ..... G09F 21/02 116/306
5,628,669 A 5/1997 Hesse
5,675,839 A * 10/1997 Gordon ..... A41D 19/01523 2/163
5,741,140 A * 4/1998 Bristol ..... B44C 3/06 446/374
7,479,054 B2 1/2009 Wittenberg
(Continued)

FOREIGN PATENT DOCUMENTS

GB 2197800 11/1986

*Primary Examiner* — Joseph B Baldori

(57) ABSTRACT

A retrofittable posable toy hand assembly includes a simulated glove including a hand portion and plurality of finger members attached to and extending away from the hand portion. The hand portion has a free edge positioned opposite of the finger members. Each of the finger members is bendable and retained in a bent position. An attachment member is positioned on the simulated glove adjacent to the free edge. The attachment member engages a mittened hand of a doll such that the mittened hand is obscured by the hand portion.

4 Claims, 7 Drawing Sheets

(56) References Cited

U.S. PATENT DOCUMENTS

| | | | | |
|---|---|---|---|---|
| 2003/0077109 | A1 | 4/2003 | Chen | |
| 2004/0018799 | A1* | 1/2004 | Lee | A63H 3/36 446/373 |
| 2004/0244092 | A1* | 12/2004 | Peil | A63B 71/146 2/169 |
| 2006/0094330 | A1* | 5/2006 | Privett | A63J 19/006 446/330 |
| 2007/0123138 | A1 | 1/2007 | Lelen | |
| 2012/0030855 | A1* | 2/2012 | Clark | A41F 1/06 2/161.1 |
| 2014/0287401 | A1* | 9/2014 | Hardy | A63H 3/46 434/365 |
| 2021/0375156 | A1* | 12/2021 | Howery | G09B 19/0076 |

* cited by examiner

RETROFITTABLE POSABLE TOY HAND ASSEMBLY AND METHOD

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to toy figure retrofittable glove device and more particularly pertains to a new toy figure retrofittable glove device for allowing a person to alter the appearance of a doll in such a manner that facilitates a photogenic nature of the doll by providing simulated personality. More particularly, the device herein will allow a person to create hand gestures with a doll where before the static nature of the doll's hands, that lack of fingers on the doll's hands, or the inability to retain a pose with the doll's hands, rendered the dolls less appealing as a medium for social networking and marketing purposes.

(2) Description of Related Art Including Information Disclosed Under 37 CFR 1.97 and 1.98

The prior art relates to toy figures that included the ability to remove and replace hands, particularly those of action figures, to allow the toy figure to engage a different activity. However, these required a number of different hand attachments and still did not allow for full functionality with respect to posing fingers of a hand into particular gestures or positions as desired. Moreover, these require the removal of the original hands of the toy figure.

BRIEF SUMMARY OF THE INVENTION

An embodiment of the disclosure meets the needs presented above by generally comprising a simulated glove including a hand portion and plurality of finger members attached to and extending away from the hand portion. The hand portion has a free edge positioned opposite of the finger members. Each of the finger members is bendable and retained in a bent position. An attachment member is positioned on the simulated glove adjacent to the free edge. The attachment member engages a mittened hand of a doll such that the mittened hand is obscured by the hand portion.

In another embodiment, a simulated glove includes a hand portion and plurality of finger members attached to and extending away from the hand portion. The hand portion has a free edge positioned opposite of the finger members and each of the finger members is bendable and retained in a bent position. An attachment member is positioned on the simulated glove adjacent to the free edge. The simulated glove is positioned such that the simulated glove obscures the mittened hand. The simulated glove is secured to the doll with the attachment member and the finger members are bent to selective positions relative to each other and the hand portion to define a pose.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
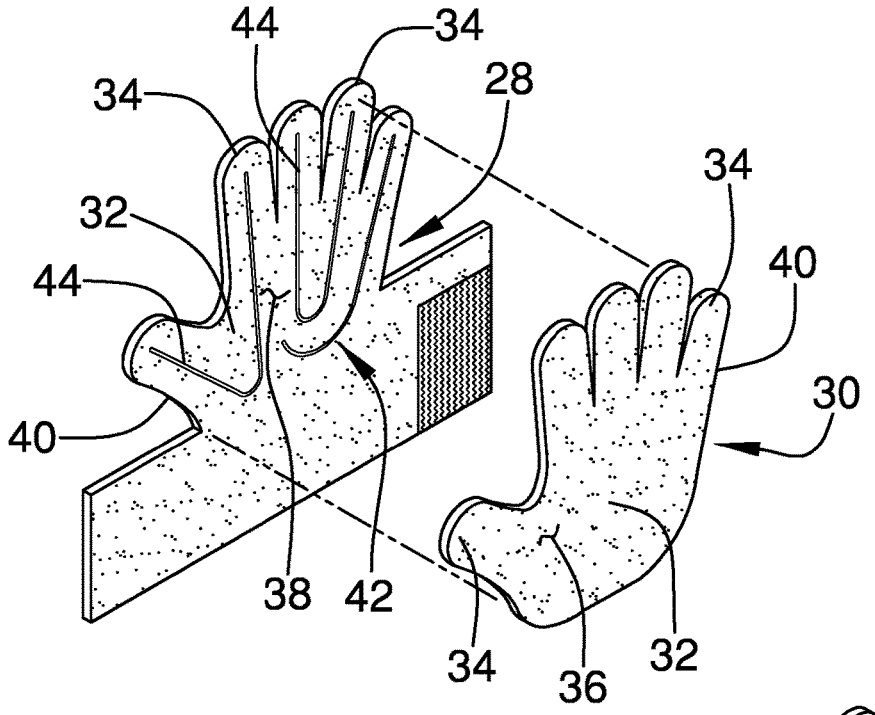
FIG. 1 is a rear isometric exploded view of a retrofittable posable toy hand assembly and method according to an embodiment of the disclosure.
Figure 2:
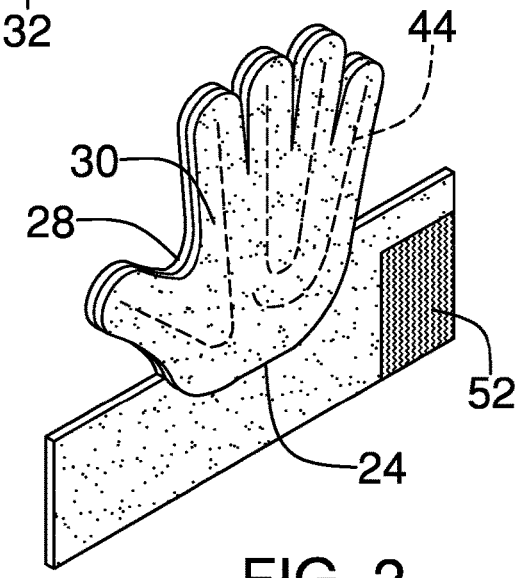
FIG. 2 is a rear isometric view of an embodiment of the disclosure.
Figure 3:
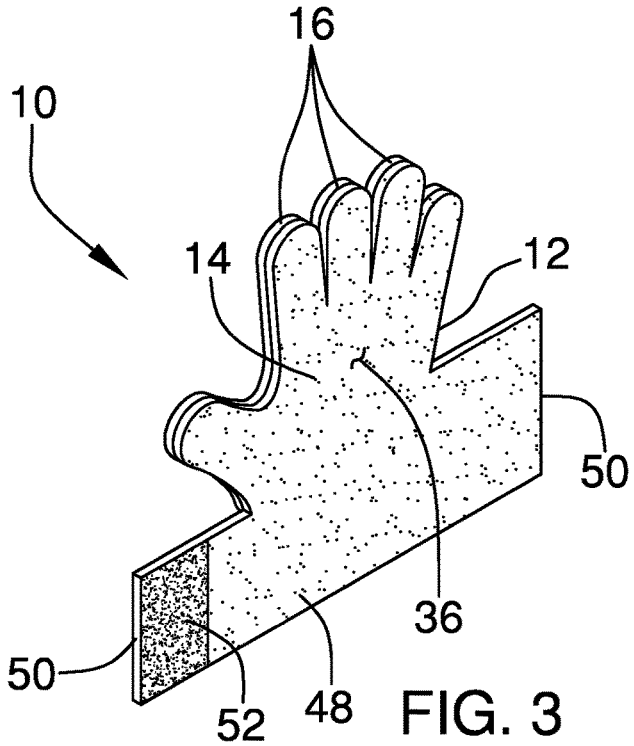
FIG. 3 is a front isometric view of an embodiment of the disclosure.
Figure 4:
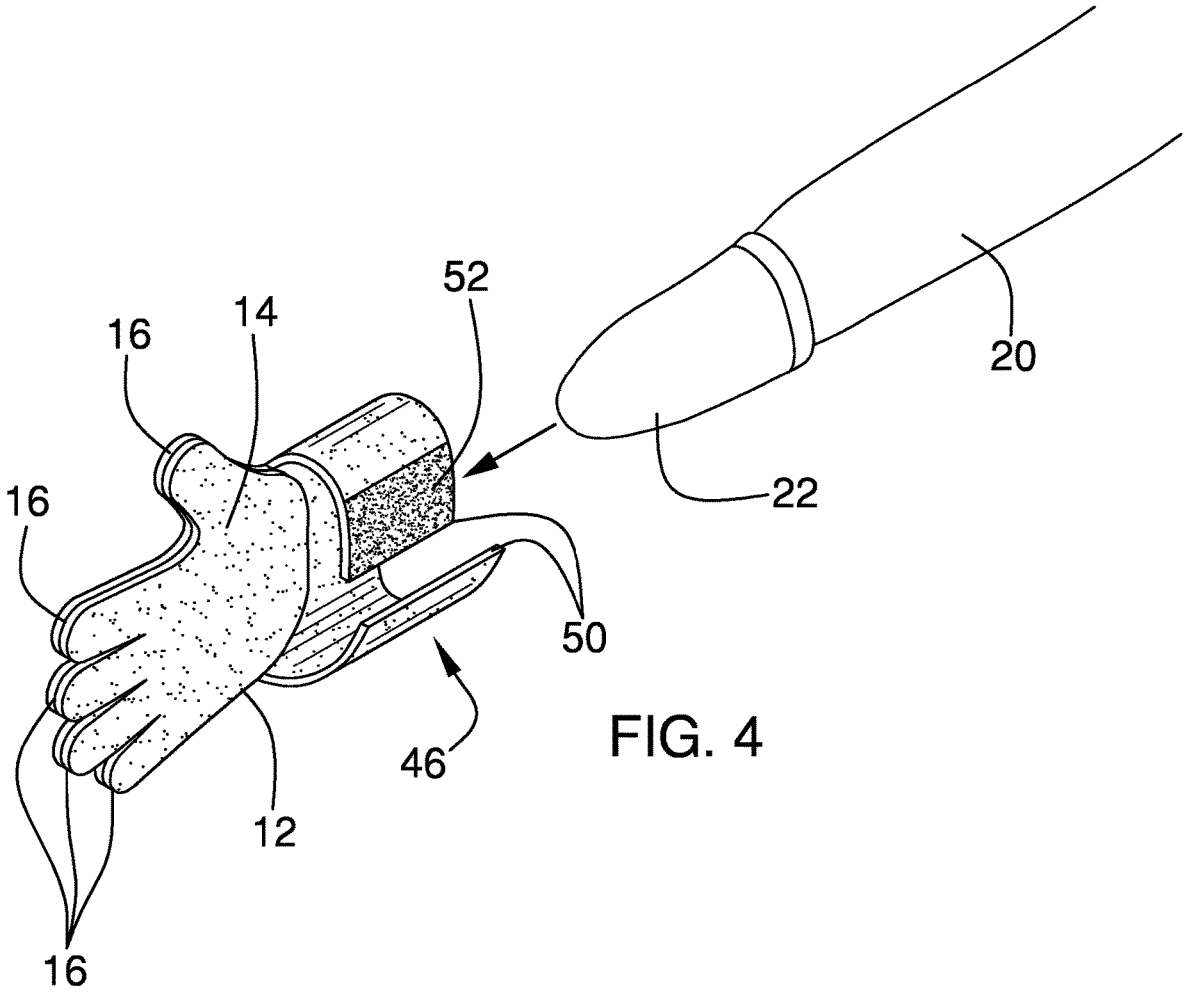
FIG. 4 is a rear and top isometric view of an embodiment of the disclosure.
Figure 5:
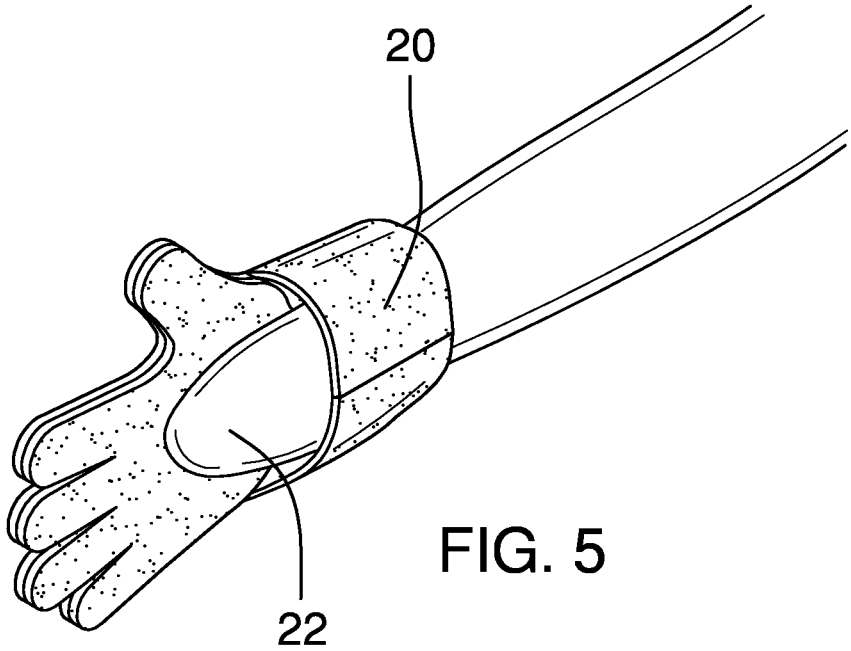
FIG. 5 is a rear and top isometric view of an embodiment of the disclosure.
Figure 6:
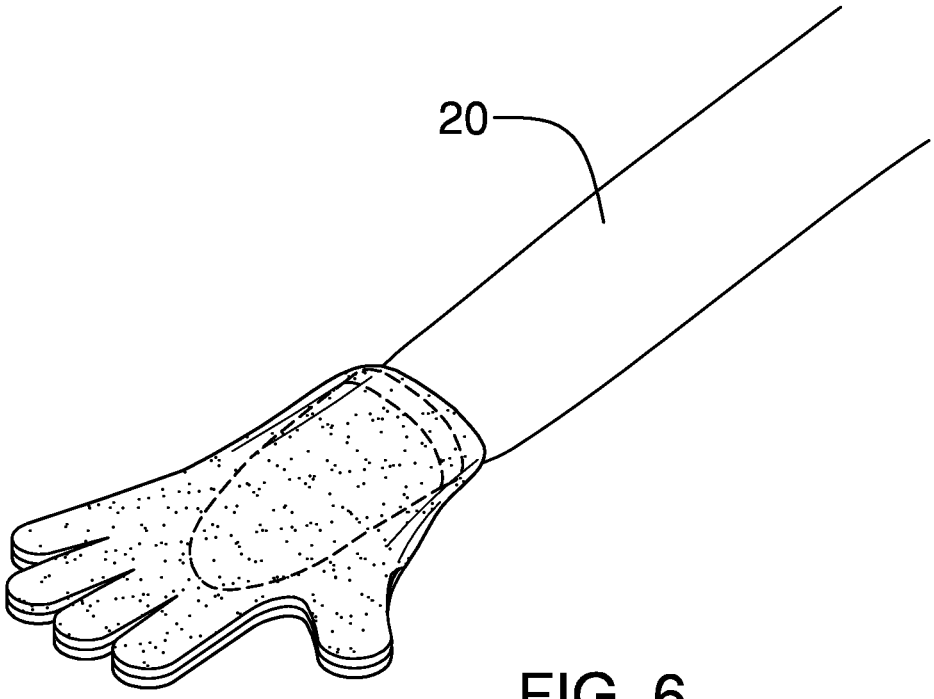
FIG. 6 is a front and top isometric view of an embodiment of the disclosure.
Figure 7:
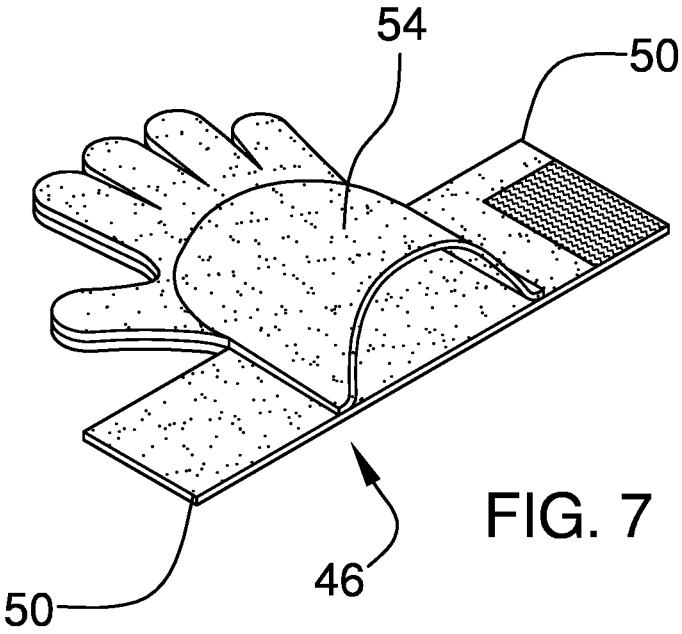
FIG. 7 is a bottom and rear isometric view of an embodiment of the disclosure including an alternate attachment member.
Figure 8:
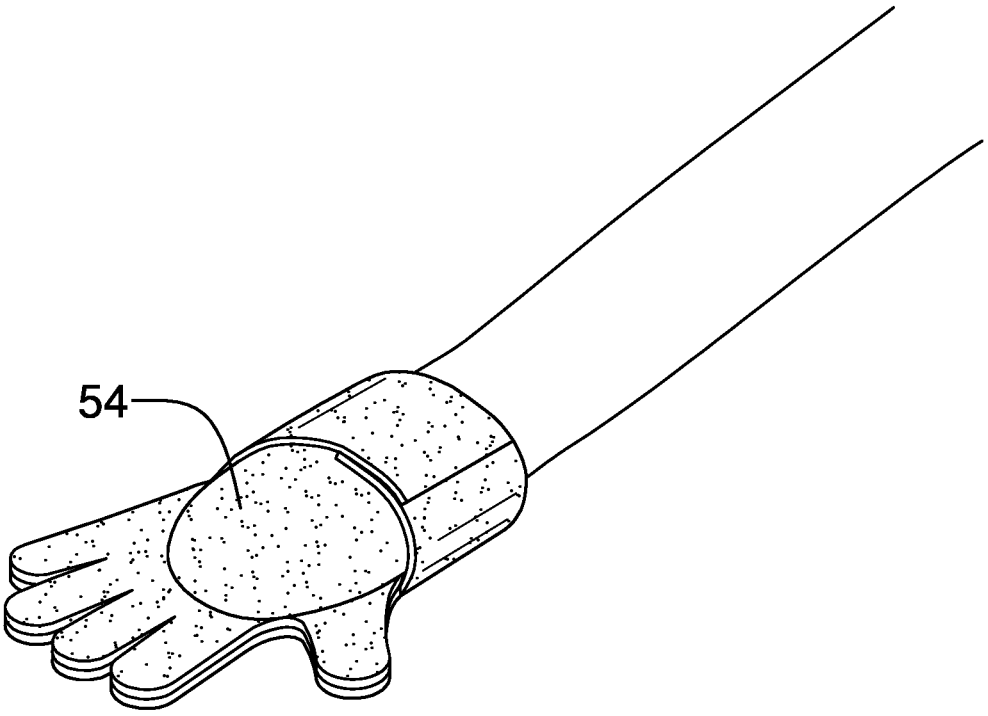
FIG. 8 is a top and rear isometric view of an embodiment of the disclosure utilizing the attachment member of FIG. 7.
Figure 9:
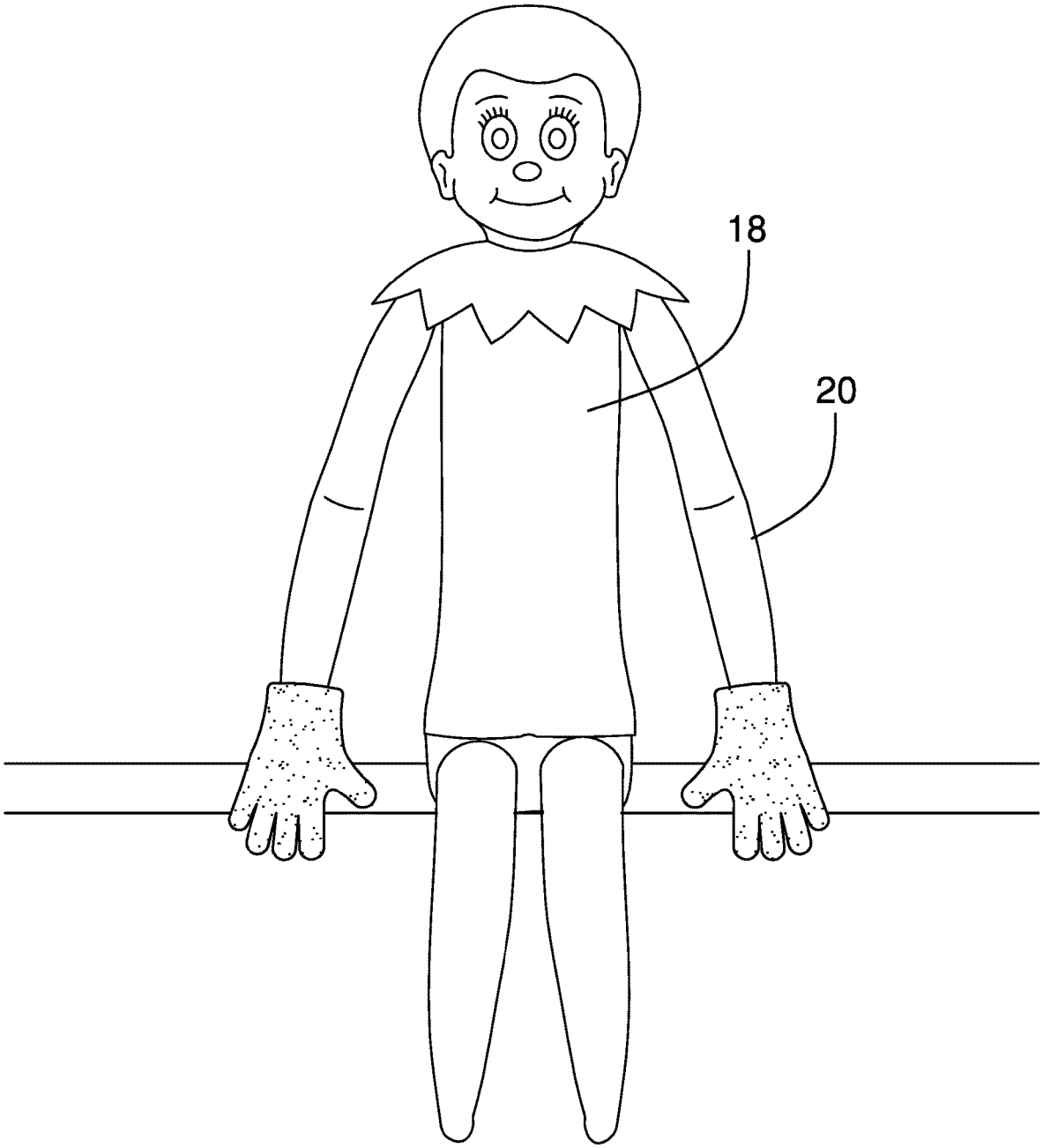
FIG. 9 is a front in-use view of an embodiment of the disclosure.

With reference now to the drawings, and in particular to FIGS. 1 through 11 thereof, a new toy figure retrofittable glove device embodying the principles and concepts of an embodiment of the disclosure and generally designated by the reference numeral 10 will be described.

Figure 10:
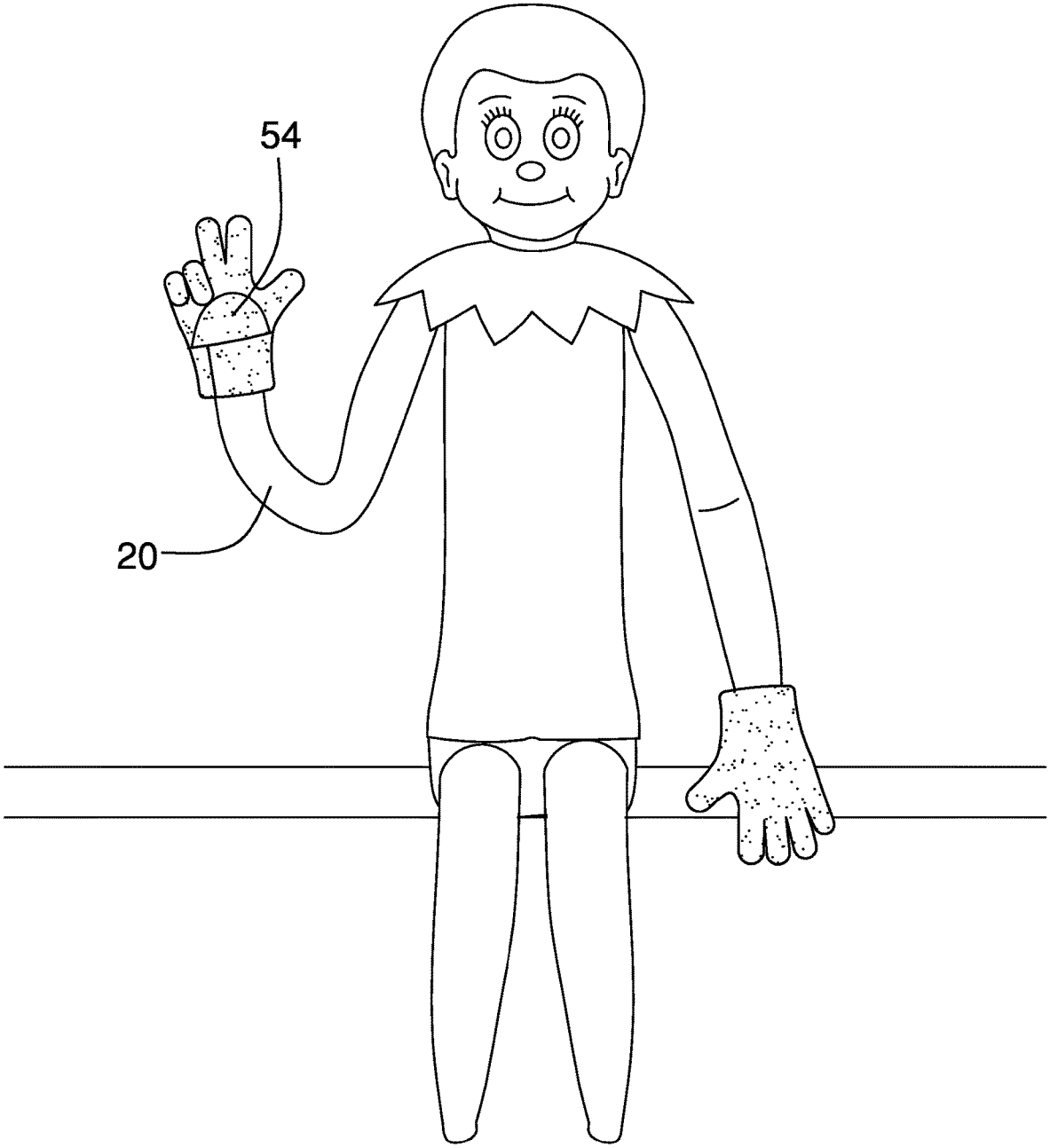
FIG. 10 is a front in-use view of an embodiment of the disclosure.
Figure 11:
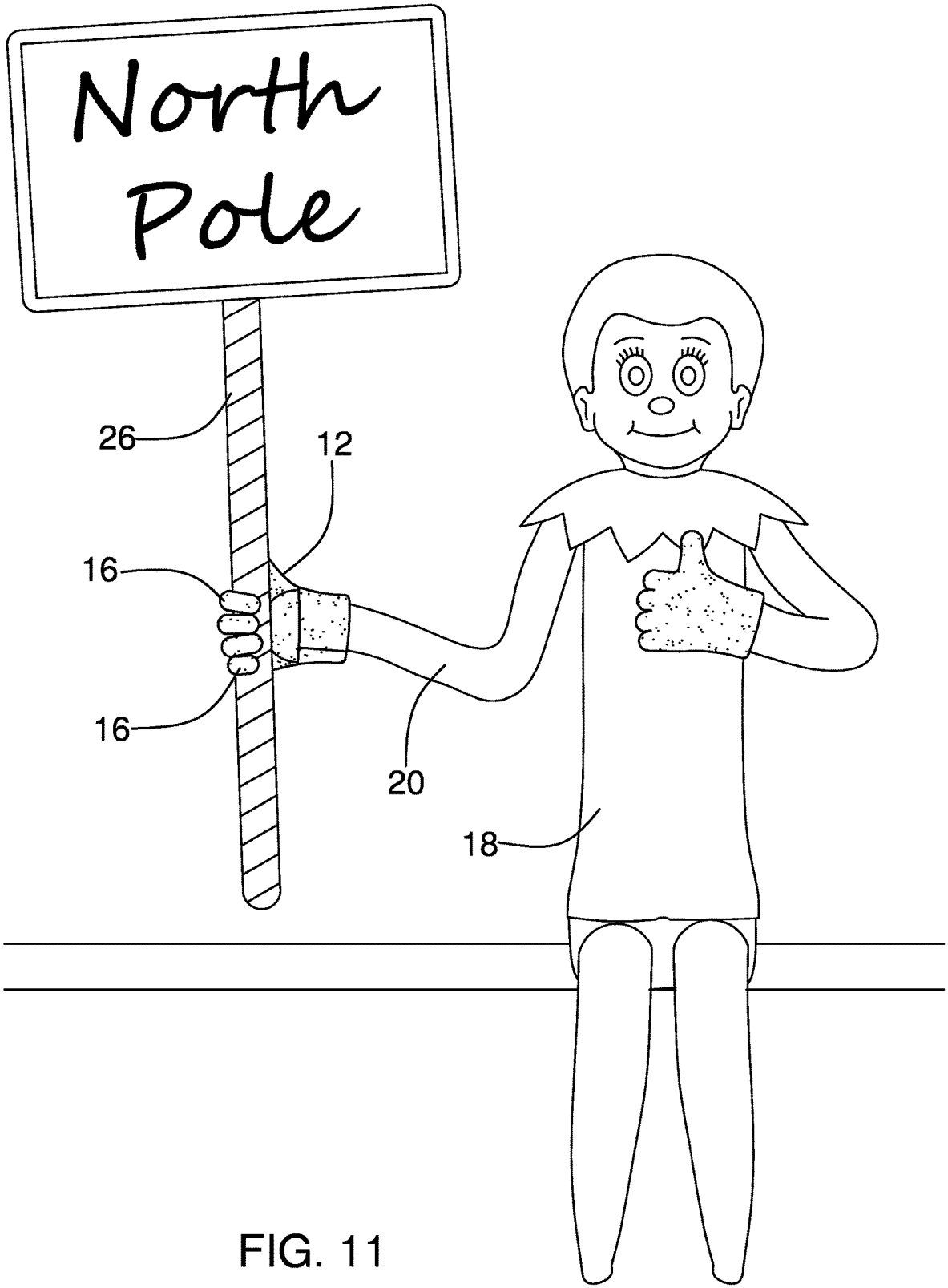
FIG. 11 is a front in-use view of an embodiment of the disclosure.

As best illustrated in FIGS. 1 through 11, the retrofittable posable toy hand assembly 10 and method generally comprises a simulated glove 12 including a hand portion 14 and plurality of finger members 16 attached to and extending away from the hand portion 14. More particularly, the simulated glove 12 will visually approximate a "gloved" hand for a toy figurine, doll, and the like. The terms doll, toy, and figurine are used interchangeably and are to be understood to include any type of action figure, toy doll and the like. More particularly, the dolls 18 in the present invention will most often include arms 20 terminating in mittened hands 22 wherein the mittened hands are attached to the arms 20 such that the mittens and mittened hands 22 are not removable to provide a static feature of the doll 18. The hand portion 14 has a free edge 24 positioned opposite of the finger members 16. Each of the finger members 16 is bendable and thereafter retained in a bent position such that the finger members 16 are posable to show hand gestures as shown in FIGS. 10 and 11 as well as allowing using the assembly 10 for gripping objects 26.

The simulated glove 12 more particularly comprises a pair of panels 28, 30 each having a glove shape including first panel 28 and a second panel 30. Each of the first 28 and second 30 panels includes a hand shaped section 32 and a plurality of finger shaped sections 34. The hand shaped sections 32 would correspond to the back of a hand and its oppositely positioned palm. The finger shaped sections 34 would typically correspond to the five fingers of a human hand though, because the assembly 10 may be used with a doll, less or more finger members may be utilized but will usually always include at least three, and more preferably four, finger shaped sections 34. Each of the panels 28, 30 has an outer surface 36, an inner surface 38 and a perimeter edge 40. The perimeter edge 40 includes the bottom edge 24 positioned opposite of the finger shaped sections 34. The panels 28, 30 are secured together such that the inner surfaces 38 face each other and the perimeter edges 40 are aligned with each other. The panels 28, 30 may be secured together in any conventional fashion including adhesives, stitching, chemical bonding, heat bonding and the like. The panels 28, 30 are comprised of a flexible material and may particularly comprise a cloth material. Often the material chosen based upon the materials used on the toy or doll 18 on which the assembly 10 is to be placed such that the assembly 10 matches the replaced or adjacent materials on the doll 18.

A formable material 42 is positioned between the panels. The formable material 42 is bendable and retains a bent shape to allow the finger members 16 to be posable and to further allow some manipulation of the hand portion 14 to allow the assembly 10 to be formed into a gripping position if needed as shown in FIG. 11. The formable material 42 may include metallic wire 44 having a diameter between about 0.5 mm and 3.0 mm. The material used for the metallic wire 44 is not overly important though the material should be easily bendable such that it retains its shape and does not easily break after repeatedly bending. Each of the finger members 16 has at least one of the metallic wires 44 therein and the metallic wires 44 extend into the hand portion 14. The metallic wire 44 may be serpentined and contoured throughout each of the finger members 16 such that only a single wire is utilized, or multiple finger members 16 may include a single metallic wire 44. Instead of metallic wire 44, a thin metallic plate may be utilized which is positioned in the hand portion 14 and extended upwardly into the finger members 16. The metallic wires 44, or metal plate, are secured to at least one of the panels 28, 30. This may be achieved by any conventional attachment and may include, for example, adhesives. The attachment of the formable material 42 to one of the panels 28, 30 prevents the movement of the formable material 42 relative to the panels 28, 30, particularly when the finger members 16 are being manipulated. It should be understood that other materials may be positioned within the simulated glove 12 such that it is posable and in some embodiments the panels 28, 30 themselves may comprise the formable material.

Adjacent to the free edge 24 of the simulated glove includes an attachment member 46 configured to engage the mittened hand 22 of the doll 18. In one embodiment, the attachment member 44 includes an elongated strip 48 that is attached to and extends along the bottom edge 24 of the first panel 28 of the pair of panels 28, 30. The elongated strip 48 extends laterally away from the first panel 28 in opposite directions to define a pair of tabs 50. The elongated strip 48 may be formed from the same, continuous material as the first panel 28 and thereby define a unitary structure with the first panel 28. A coupler 52 releasably attaches the tabs 50 together to form a closed loop configured to encircle an arm 20 of the doll 18 adjacent to the mittened hand 22. The coupler 52 may include hook and loop couplers, adhesives, mechanical fasteners such as clips and pins, and the like. The attachment member 46 may instead include a permanent loop of material for receiving the mittened hand 22 and further may incorporate resiliently elastic materials therein such that the permanent loop is stretchable to engage the doll tightly and frictionally. In another embodiment, the attachment member 46 comprises a sleeve 54 which receives the mittened hand 22. Such an embodiment may include the tabs 50 which are extended around the arm 20 and secured in place as stated above to retain the mittened hand 22 within the sleeve 54. The sleeve 54 may instead include one of the mating members of a hook and loop coupler to engage with another mating member adhered to the mittened glove 22. Finally, the attachment member 46 may comprise a connector directly engaging the mittened hand 22 and the hand portion 14 of one of the panels 28, 30 such as an adhesive, or mating members wherein one of the mating members is attached to the hand portion 14 of one of the panels 28, 30 and one of the mating members is attached to the mittened hand 20. The mating members may include hook and loop couplers, snaps, buttons, and the like.

In use, a doll 18 is provided with an arm 20 terminating with the mittened hand 22. The simulated glove 12 is positioned on the mittened hand 22 such that the simulated glove 12 obscures the mittened hand 22. The simulated glove 12 is then secured to the doll 18 with the attachment member 46. Finally, the finger members 16 are bent and selectively positioned relative to each other and the hand portion 14 to define a pose. In one embodiment, the arm 20 is encircled with the pair of tabs 50 of the attachment member 46 to form an enclosed loop with the tabs 50 and the tabs 50 attached together with a coupler 52. In another embodiment, the mittened hand 20 is extended into the sleeve 54 of the simulated glove 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A method of retrofitting a mittened doll with a posable glove comprising the steps of:

providing a doll having an arm terminating with a mitten;

providing a simulated glove including a hand portion and plurality of finger members being attached to and extending away from the hand portion, the hand portion having a free edge positioned opposite of the finger members, each of the finger members being bendable and retained in a bent position, an attachment member being positioned on the simulated glove adjacent to the free edge;

positioning the simulated glove such that the simulated glove obscures the mittened hand;

securing the simulated glove to the doll with the attachment member; and bending the finger members to selective positions relative to each other and the hand portion to define a pose.

2. The method of retrofitting a mittened doll with a posable glove according to claim 1, wherein the step of securing the simulated glove to the doll further includes:

the steps of encircling the arm with a pair of tabs of the attachment member to form an enclosed loop with the tabs; and attaching the tabs together with a coupler.

3. The method of retrofitting a mittened doll with a posable glove according to claim 1, wherein the step of securing the simulated glove to the doll includes extending the mitten into a sleeve of the simulated glove.

4. The method of retrofitting a mittened doll with a posable glove according to claim 1, wherein the step of bending the finger members further includes bending metallic wires positioned within the finger members and hand portion.

* * * * *